US008869885B2

(12) United States Patent
O'Malley

(10) Patent No.: US 8,869,885 B2
(45) Date of Patent: Oct. 28, 2014

(54) FLUID METERING TOOL WITH FEEDBACK ARRANGEMENT AND METHOD

(75) Inventor: Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 457 days.

(21) Appl. No.: 12/853,850

(22) Filed: Aug. 10, 2010

(65) Prior Publication Data

US 2012/0037362 A1 Feb. 16, 2012

(51) Int. Cl.
*E21B 47/09* (2012.01)

(52) U.S. Cl.
CPC ..... *E21B 47/09* (2013.01); *E21B 47/091* (2013.01)
USPC ..... 166/177.1; 166/255.1

(58) Field of Classification Search
USPC ..... 175/40, 45, 293, 296, 299; 166/177.1, 166/249, 255.1
See application file for complete search history.

(56) References Cited

U.S. PATENT DOCUMENTS 3,191,537 A * 6/1965 Bodine ..... 417/241
3,532,174 A * 10/1970 Hinks et al. ..... 175/56
3,768,576 A * 10/1973 Martini ..... 173/73
4,291,395 A 9/1981 Holmes
5,117,398 A * 5/1992 Jeter ..... 367/85
5,158,142 A * 10/1992 Miszewski et al. ..... 166/377
5,831,934 A * 11/1998 Gill et al. ..... 367/25
6,206,101 B1 * 3/2001 Bakke ..... 166/301
6,540,025 B2 * 4/2003 Scott et al. ..... 166/355
7,249,633 B2 * 7/2007 Ravensbergen et al. ..... 166/301
7,281,575 B2 * 10/2007 McElroy et al. ..... 166/178
7,284,606 B2 10/2007 Coronado
7,423,932 B1 * 9/2008 Jeter ..... 367/85
8,162,078 B2 * 4/2012 Anderson ..... 175/56
2007/0056771 A1 * 3/2007 Gopalan et al. ..... 175/40
2008/0156536 A1 * 7/2008 Hall et al. ..... 175/57
2008/0271923 A1 * 11/2008 Kusko et al. ..... 175/25
2008/0302528 A1 * 12/2008 Samaroo et al. ..... 166/249
2011/0198126 A1 * 8/2011 Swietlik et al. ..... 175/55

OTHER PUBLICATIONS

Bacri et al. "Magnetic-fluid oscillator: Observation of nonlinear period doubling," Physical Review Letters, vol. 67, Jul. 1, 1991, pp. 50-53. [Abstract Only].
Dowell, E.H. "Non-linear oscillator models in bluff body aero-elasticity," Journal of Sound and Vibration, vol. 75, Issue 2, Mar. 22, 1981, pp. 251-264. [Abstract Only].
Kokubun et al. "A bending and stretching mode crystal oscillator as a friction vacuum gauge," Vacuum, vol. 34, Issues 8-9, Aug.-Sep. 1984, pp. 731-735. [Abstract Only].

* cited by examiner

*Primary Examiner* — Kenneth L Thompson
(74) *Attorney, Agent, or Firm* — Cantor Colburn LLP

(57) ABSTRACT

A downhole tool with a feedback arrangement including a tool having one or more fluid outflow ports that exhaust fluid during normal operation of the tool. A feedback arrangement in operable communication with the fluid exhausted from the one or more fluid outflow ports during operation of the tool. The feedback arrangement interacting with exhausting fluid to produce a signal receivable at a remote location indicative of proper tool operation. A method for confirming operation of a downhole tool is included.

11 Claims, 2 Drawing Sheets

FLUID METERING TOOL WITH FEEDBACK ARRANGEMENT AND METHOD

BACKGROUND

In drilling and completion industries such as hydrocarbon exploration and production, Carbon Dioxide sequestration, etc., tools are often run into the downhole environment for particular purposes requiring locating the tool at a target position. Traditionally an operator will keep track of a length of tubing in the hole and anticipate the specific tool at issue locating upon a feature within the hole. The feature may be a seat, profile, bottom, etc. Such "gauging" of where the tool is occurs in trips into the borehole, trips out of the borehole and movements of the tool in defined areas of the borehole.

For example, an operation in a borehole may require several actions taking place between a downhole most location and an uphole most location for the particular operation. Providing profiles at these locations will provide a guide to the operator to keep the target tool in the target location for the job being done.

While such measures are currently used, tools do not always engage profile properly and effective indication of position at the surface may not be received. Such situations result in lost time, which translates to cost increases.

In order to address the foregoing, a downhole position locating device with fluid metering feature (U.S. Pat. No. 7,284,606, the entirety of which is incorporated herein by reference) was developed. Such a tool or others that function by providing a fluid movement component of their operation, which fluid component has an effect on tool operation such as in the '606 patent wherein the fluid delays an action until the fluid is removed by exhaustion or by movement to another chamber are useful as landing in a sought profile is better verifiable by a pull or push from surface that allows for a slower movement of the string. While the concept generally works well, there is a possibility that the tool experiences restricted movement due to friction, Blow Out Preventer (BOP) contact or other impediments rather than due to an engagement with a profile and fluid movement. In such case, the indication of tool location at surface would be inaccurate. Since accuracy in downhole operations improves efficiency and reduces costs, the industry will well receive improved arrangements supporting these goals.

SUMMARY

A downhole tool with a feedback arrangement including a tool having one or more fluid outflow ports that exhaust fluid during normal operation of the tool; and a feedback arrangement in operable communication with the fluid exhausted from the one or more fluid outflow ports during operation of the tool, the feedback arrangement interacting with exhausting fluid to produce a signal receivable at a remote location indicative of proper tool operation.

A method for confirming operation of a downhole tool including disposing an oscillator within a fluid outflow path; actuating the tool thereby causing fluid to flow in the outflow path; affecting the oscillator with the fluid; and creating a signal with the oscillator representative of tool operation.

BRIEF DESCRIPTION OF THE DRAWINGS

Referring now to the drawings wherein like elements are numbered alike in the several Figures.

DETAILED DESCRIPTION

It is to be appreciated that while the overall configuration of the metering tool of the '606 patent is utilized to illustrate two embodiments of the disclosed invention, other configurations where fluid movement is a part of the function of the tool will also benefit from the embodiments providing feedback as described herein.

Figures 1A, 1B, 1C:
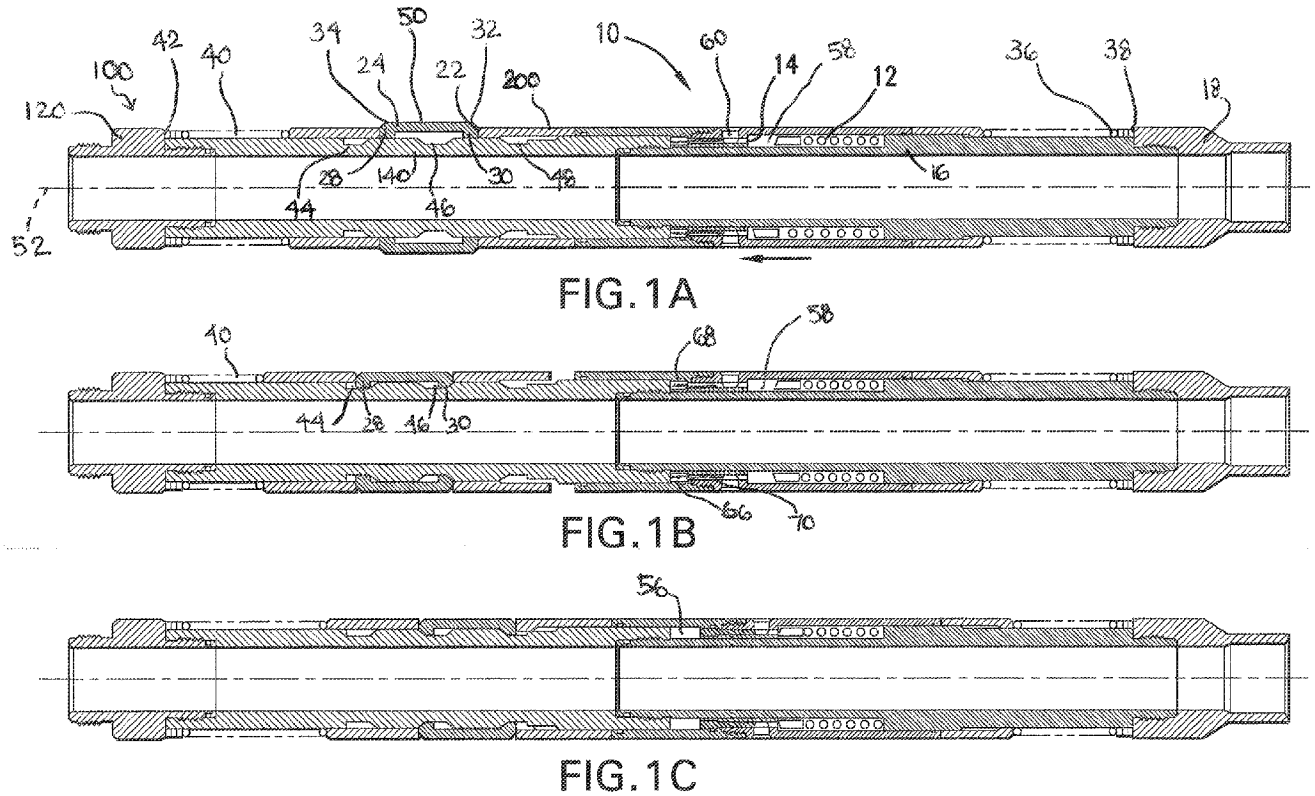
FIGS. 1A-C is a representation of one embodiment of a metering tool with feedback arrangement in three distinct positions.

Referring to FIGS. 1A-C, a metering tool 10 is generally depicted with a feedback arrangement including an oscillator 12. The metering tool 10 is also shown to include an exemplary embodiment where fluid movement is a part of the function of the tool. The illustrated exemplary embodiment includes a mandrel 100 made up of top sub 120, upper body 140, lower body 16 and bottom sub 18. An outer sleeve 200 has a window 22 for each dog 24 that is used. One or more dogs 24 can be used. Dogs 24 have tabs at opposed ends to limit the outward travel of the dogs 24 with respect to window 22. FIG. 1A shows the dog 24 in section. The dog 24 is generally U-shaped having a pair of inwardly oriented legs 28 and 30. On the trip into the well, surface 32 on dog 24 may encounter an obstacle. On the trip out of the well, surface 34 on dog 24 may encounter an obstacle. Sleeve 200 is mounted to slide over mandrel 10. It is biased uphole by spring 36 that bears on surface 38 of bottom sub 18. Spring 40 bears on surface 42 of top sub 120 and applies an opposing force to sleeve 20 than spring 36. Spring 40 may be weaker than spring 36 for reasons that will be explained below.

Upper body 140 has three grooves 44, 46, and 48. These grooves are deep enough so that when legs 28 and 30 are in them, outer surface 50 of dogs 24 recedes inside of window 22. In this manner the tool 10 can pass an obstruction going downhole and can be removed after release going uphole. If an obstruction is encountered by surface 32 going in the hole, the spring 40 is compressed as the sleeve 20 and dogs 24 stop downhole motion. Continued downhole movement of the mandrel 100 not only compresses spring 40 but also positions grooves 44 and 46 in alignment with legs 28 and 30 of dogs 24 to allow them to retract to a position closer to the central axis 52 and within sleeve 200. At that point the obstruction can be passed and spring 40 can bias the sleeve 200 back into the neutral position shown in FIG. 1A. FIG. 1B shows the legs 28 and 30 getting cammed out of grooves 44 and 46 by the action of spring 40 after the obstruction going downhole is cleared. Note that sloping surfaces 52 and 54 facilitate the exit of legs 28 and 30 from grooves 44 and 46 under the return force of the formerly compressed spring 40. With the obstacle cleared going downhole, the dogs 24 resume the neutral run in position shown in FIG. 1A.

Between the sleeve 200 and mandrel 100 an upper fluid reservoir 56 (FIG. 1C) and a lower fluid reservoir 58. A fill port 60 allows charging the fluid at the surface. Thermal and hydrostatic effects in this closed system of interconnected reservoirs are fully compensated by a piston that can be biased by Belleville washers, for example, or any other device that is comparable. Those skilled in the art will appreciate the benefit of such compensation on the structure of the device especially when it is deployed at great depths and/or high temperature applications. FIG. 1B best illustrates other features of this reservoir system. There is a flow restrictor 66 that regulates the flow rate from reservoir 58 into reservoir 56. There is a check valve 68 that permits a bypass of restrictor 66 when the fluid is flowing in the opposite direction from reservoir 56 to reservoir 58. A pressure relief device 70 is in line with the restrictor 66 so that when fluid is urged in a direction from reservoir 58 to reservoir 56 there will have to be a rise in the driving pressure to cause such flow to a predetermined level before any flow begins.

The fluid system is operative to create a delay as the dogs 24 are in the desired location and a force is applied to the mandrel 100 to create a surface signal for such engagement prior to the release of the dogs 24 from the locating groove (not shown). In the exemplary embodiments further described herein, the feedback arrangement is further provided features to produce an oscillating or pulsating signal that is more easily discernible at a remote location. The system also serves to allow a reduction of the applied pulling force before release to reduce the slingshot effect from release. When used with the optional pressure relief device 70 the tool can be inverted and can be used to apply a load in a predetermined range on a BHA without concern for premature release, such as an offshore drilling application where a heavy compensator system is employed.

FIG. 1A shows the run in position with the dogs 24 having legs 28 and 30 out of any of the grooves 44, 46, and 48. The dogs may be biased into the FIG. 1A position where legs 28 and 30 straddle groove 46 by virtue of spring 36 overpowering spring 40 to move sleeve 200 to the FIG. 1A position. As the tool is brought downhole, an obstacle will first hit surface 32 on dogs 24. The mandrel 100 will continue downhole as the dogs 24 stop the descent of the sleeve 200. As grooves 44 and 46 come into alignment with legs 28 and 30, the dogs 24 will be able to retract sufficiently to allow the tool to continue past the obstacle. The dogs 24 can retract within sleeve 200 as much as necessary to allow the obstacle to be cleared. The advancing of the mandrel 100 with the dogs 24 temporarily stuck on an obstacle, compresses spring 40. After the obstacle is cleared, spring 40 relaxes to return the tool to the FIG. 1A position from the FIG. 1B position. It should be noted that advancing the mandrel downhole with the dogs 24 stopped by an obstacle will result in sleeve 200 taking dogs 24 against the bias of spring 40 taking the lower end 21 of sleeve 200 away from upper end 23 of sleeve 25, whose relative movement with respect to the mandrel 100, at other times, creates movement of fluid between reservoirs 56 and 58. The amount of this movement to reset the dogs 24 to the FIG. 1A position after clearing the obstacle is also quite short.

When the desired depth is reached, the tool is pulled up until the surface 34 engages a desired locating groove downhole. At that point, further upward pulling on the mandrel 10 from the work string (not shown) will force fluid from reservoir 58 to reservoir 56 through restrictor 66. This regulates the rate of movement of mandrel 100 as the force is being applied to give surface personnel the time to notice a signal that the desired groove has been engaged and a force that well exceeds the potential drag force from friction of slip/stick effects on the work string in a deviated wellbore are applied. The rig crew can then actually lower the applied pulling force before the actual release happens to reduce the slingshot effect from the release. Release occurs after the mandrel 100 moves a sufficient distance to place grooves 46 and 48 in alignment with legs 28 and 30 to allow the dogs 24 to retract and the tool to be returned to the FIG. 1A position. This occurs because the pulling uphole with the dogs 24 in the locating groove compresses spring 36 as seen in FIG. 1C. Retraction of the dogs 24 allows spring 36 to overcome spring 40 and the tool returns to the FIG. 1A position, ready for another cycle. With the use of the optional relief device 70 the surface personnel are assured that a pulling force up to a predetermined level will not initiate the release sequence. Hence force can be applied and removed any number of times before there is a release. Those skilled in the art will appreciate that the tool can be used in an inverted orientation and function similarly in one application, for example where a range of weight on a BHA is desired in a given range without fear of initiating a release sequence. In such an application, rather than a pulling force uphole, a pushing force downhole is applied with the dogs 24 engaged in a receptacle. Combining with the use of the optional relief device 70 no fluid flow between reservoirs 56 and 58 can happen until a predetermined force is exceeded. This configuration can be used in offshore drilling in conjunction with heave compensators.

The use of the check valve 68 allows the tool to quickly find its neutral position after a release so that the test can be quickly repeated, if desired. The use of the restrictor 66 allows more time at the surface to hold a force before release and further allows lowering the applied force after the passage of time but before release to reduce the slingshot effect from release. The pressure relief device 70 allows application of force for any desired time without fear of release if the force is kept at a level where the relief device remains closed. The fluid used on the reservoirs can be a liquid or gas. The compensator is an optional feature. The tool is serviceable in the well in opposed orientations depending on the intended service. Although four dogs 24 are illustrated one or more such dogs can be used. Biasing of springs 26 and 40 can be accomplished by equivalent devices.

In the embodiment of FIGS. 1A-1C, the feedback arrangement is an oscillator 12 illustrated as a spring mass that is positioned within a fluid outflow through outflow port(s) 14 caused by metering of the metering tool 10. It is to be understood that although a spring mass is illustrated as oscillator 12, any mass that can be caused to oscillate due to fluid flow can be used. As will be appreciated from a review of the metering tool in the incorporated by reference '606 patent, fluid is exhausted from chamber 56 to chamber 58, or from chamber 58 to chamber 56, during the normal operation of the tool 10, such as when a dog 24 engages a desired locating groove downhole. Because of the placement of the oscillator 12 within reservoir 58, the fluid flow through outflow port(s) 14 interacts with the oscillator 12 to cause the oscillator 12 to oscillate. Oscillation of the oscillator 12 produces a signal that can be received at remote locations and is indicative of proper tool operation, such as when the dog 24 engages a desired locating groove downhole. Different forms of oscillation can be transmitted to remote locations for reliable feedback of the operation of the tool. In this case, the spring mass, which may be a coil spring as shown, oscillates against the tool itself creating vibration that is transmitted through a string 16 supporting the tool back to surface or other remote location. The vibration is detectable at the remote location by hand or sensor or auditorily and confirms proper operation of the tool in the downhole environment.

Figures 2A, 2B, 2C, 3:
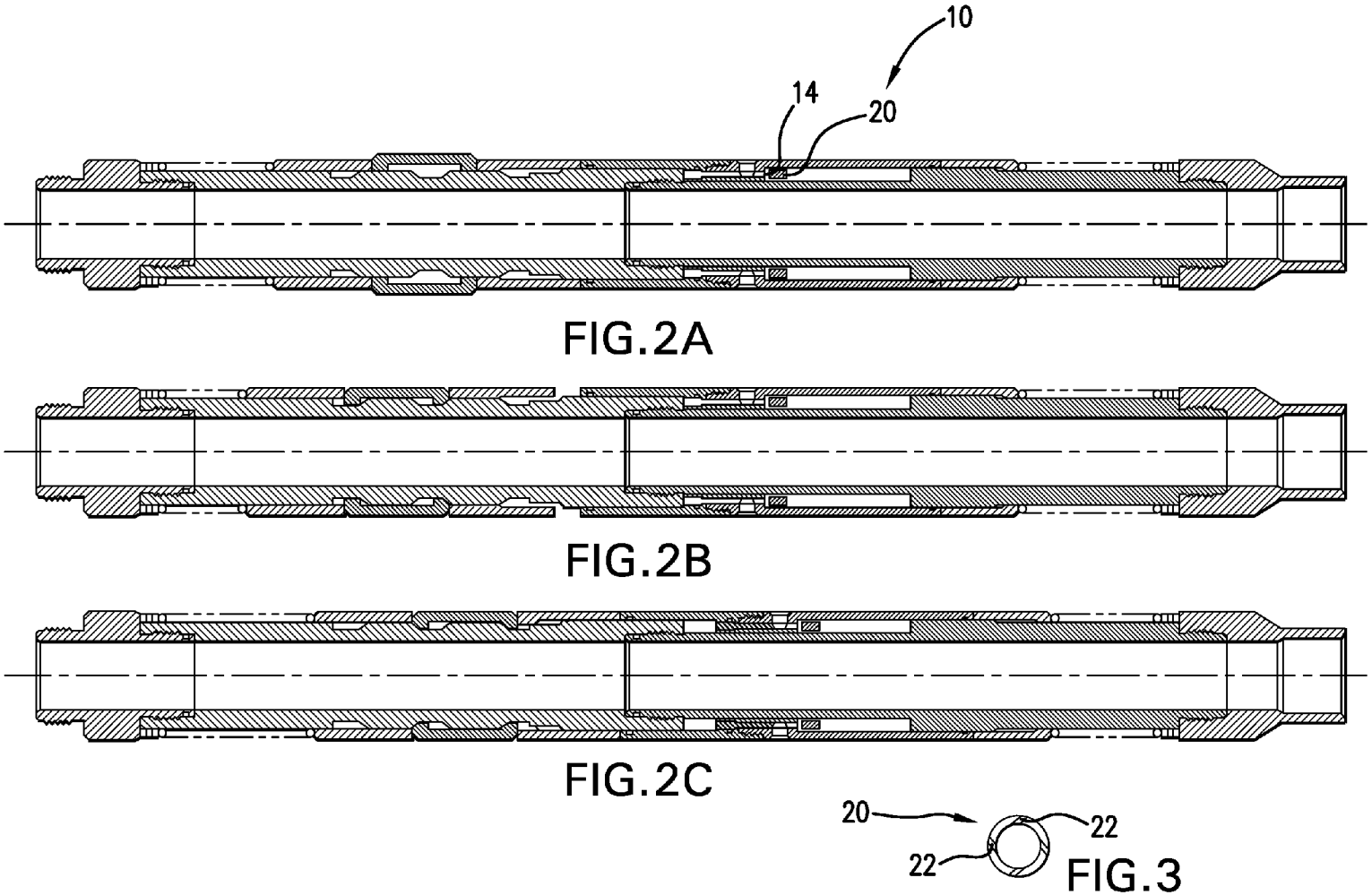
FIGS. 2A-C is a representation of another embodiment of a metering tool with feedback arrangement in three distinct positions.
FIG. 3 is a plan view of an embodiment of a pulser.

In another embodiment, referring to FIGS. 2A-C, a metering tool 10 with a feedback arrangement includes a pulser 20 mounted proximate a fluid outflow through the outflow port(s) 14 of the tool 10. Upon fluid outflow, the pulser arrangement will rotate. The pulser, in one embodiment is hence a rotating member. Rotation of the pulser is due to one or more (four shown) openings 22 in the pulser 20 that are configured angularly relative to an axis of the rotatable pulser. Rotation of the pulser 20 results in an alternating pattern of openings and solid sections of the pulser aligning with the fluid outflow of the tool 10. This alternatingly allows fluid passage and fluid blockage (or at least inhibition). Accordingly, pressure within the fluid downstream of the pulser changes alternatingly at the same rate that the pulser rotates. Pressure downstream of the pulser decreases when fluid flow is inhibited and returns to system pressure with each alignment of the openings 22. More particularly, when one of the openings (or more of them if there are more fluid outflow ports or if the pulser is configured to align more than one of the openings with the fluid outflow (in the event that the fluid outflow is broader in area than one of the openings 22 plus an adjacent solid portion of the pulser 20) is aligned with the fluid outflow, the pressure downstream of the pulser is the same as it is upstream of the pulser. When the pulser rotates to a position where the fluid flow from the outflow port(s) is blocked or inhibited, the pressure in the fluid downstream of the pulser dips. The dip in pressure and subsequent recovery of system pressure can be received and in some cases might actually be measured a substantial distance from the pulser 20 and tool 10. The pressure change is embodied as an acoustic signal propagating through fluid in the borehole and provides feedback at a remote location or at the surface of fluid outflow from the outflow port(s). Depending upon the length of time a particular tool has a fluid outflow, the acoustic signal may have time to reach a remote location such as the surface to be perceived or the signal may act as a post actuation confirmatory signal. This is because an appreciable amount time is required for signal propagation in a fluid medium. And while clearly the time factor for signal propagation in a fluid medium is directly related to the density of that fluid, (and of course distance is a factor in overall travel time) in virtually all cases of fluid borne acoustic signals from downhole tools, it will be likely that the actuation time causing the fluid outflow will be less than the transit time for the signal hence making such signals confirmatory.

While the foregoing embodiment provides one method for propagating a signal based upon the structure shown, there is another that provides for much less of a time delay. This utilizes the actual work string the tool is disposed in to propagate a vibratory signal. Because the pulser, in addition to what it does as noted above, will also cause pressure variations in the tool that is exhausting fluid, the string itself experiences varying strain that is cyclic. A cyclic change in tensile strain can function as a signal. More specifically, and using the metering tool of the '606 patent as an example, as the tool contacts a locating profile, applied tension displaces fluid through the outflow ports and past the pulser. The flow of fluid rotates the pulser thereby restricting and unrestricting the flow of liquid through the ports. This variance in restriction results in a variance of the pressure within the tool chamber. The variance in chamber pressure in the tool will be manifested as a variance in force between the metering tool and the profile. This force variation is detectable as a variance in tensile force in the workstring upon which the tool has been run and operated. The signal provides increased confidence that the tool 10 is operating properly. One benefit of this embodiment is the speed at which a signal will propagate through metal as opposed to a fluid. In view of this speed increase, the signal is received virtually contemporaneously with the tool actuation.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A downhole tool with a feedback arrangement comprising:

a tool having a mandrel, a sleeve, at least one dog mounted relative to the mandrel and sleeve for radial extension and retraction, first and second reservoirs disposed between the mandrel and the sleeve, and one or more fluid outflow ports configured to exhaust fluid between the first and second reservoirs; and the feedback arrangement including an oscillator disposed within one of the first and second reservoirs and in operable communication with fluid flow of the fluid exhausted from the one or more fluid outflow ports during relative movement between the sleeve and mandrel, the oscillator interacting with exhausting fluid to cause the oscillator to oscillate to produce a signal receivable at a remote location indicative of engagement of the at least one dog at a selected downhole location, the oscillator including a spring mass that oscillates in response to fluid flow therepast to cause a vibration in the tool and a string supporting the tool.

2. A downhole tool with a feedback arrangement as claimed in claim 1 wherein the spring mass is a coil spring.

3. A downhole tool with a feedback arrangement comprising:

a tool having first and second reservoirs and one or more fluid outflow ports that exhaust fluid between the first and second reservoirs; and a rotatable pulser disposed within one of the first and second reservoirs and having one or more openings therein in operable communication with the fluid exhausted from the one or more fluid outflow ports during operation of the tool, the one or more openings being angularly positioned relative to a rotatable axis of the pulser such that fluid flowing past the pulser will cause the pulser to rotate, the pulser interacting with exhausting fluid to produce a signal receivable at a remote location.

4. A downhole tool with a feedback arrangement as claimed in claim 3 wherein the feedback arrangement causes variance in a tensile force in a string connected to the downhole tool.

5. A downhole tool with a feedback arrangement as claimed in claim 4 wherein the variance is cyclic.

6. A method for confirming operation of a downhole tool comprising:

disposing an oscillator within one of first and second reservoirs in the tool and within a fluid outflow path between the first and second reservoirs;

actuating the tool by engaging a dog with a selected downhole location thereby causing fluid to flow in the outflow path;

actuating the oscillator solely with the fluid to oscillate within the one of first and second reservoirs; and, creating a signal with the oscillator representative of engagement of the dog with the selected downhole location.

7. A method as claimed in claim 6 wherein actuating the oscillator includes causing the oscillator to vibrate and create a vibration in the string.

8. A method for confirming operation of a downhole tool comprising:

disposing a rotatable pulser within one of first and second reservoirs in the tool and within a fluid outflow path between the first and second reservoirs;

actuating the tool by engaging a dog with a selected downhole location thereby causing fluid to flow in the outflow path;

rotating the rotatable pulser solely with the fluid; and, creating a signal with the rotatable pulser representative of engagement of the dog with the selected downhole location;

wherein actuating the rotatable pulser includes causing a pressure variation in fluid downstream of the pulser to create a fluid propagated acoustic signal.

9. A method as claimed in claim 8 wherein actuating the rotatable pulser includes causing a pressure variance within the tool thereby causing a tensile strain difference in the string.

10. A method as claimed in claim 9 wherein the tensile strain difference is cyclic.

11. A downhole tool with a feedback arrangement as claimed in claim 1, wherein the at least one dog is retractable within the sleeve to clear the selected downhole location in a first direction, and engageable with the selected downhole location in a second direction opposite the first direction.

* * * * *